US011185461B2

(12) United States Patent
Crosby

(10) Patent No.: US 11,185,461 B2
(45) Date of Patent: Nov. 30, 2021

(54) SYSTEM AND APPARATUS FOR MOBILITY CANE FOR THE VISUALLY IMPAIRED

(71) Applicant: Smart Guider, Inc., San Diego, CA (US)

(72) Inventor: Kelvin William Crosby, San Diego, CA (US)

(73) Assignee: Smart Guider, Inc., San Diego, CA (US)

( * ) Notice: Subject to any disclaimer, the term of this patent is extended or adjusted under 35 U.S.C. 154(b) by 0 days.

(21) Appl. No.: 16/880,048

(22) Filed: May 21, 2020

(65) Prior Publication Data

US 2020/0368099 A1 Nov. 26, 2020

Related U.S. Application Data

(60) Provisional application No. 62/850,940, filed on May 21, 2019.

(51) Int. Cl.
*A61H 3/06* (2006.01)

(52) U.S. Cl.
CPC ..... *A61H 3/068* (2013.01); *A61H 2201/0188* (2013.01); *A61H 2201/5012* (2013.01); *A61H 2201/5082* (2013.01); *A61H 2201/5084* (2013.01); *A61H 2201/5097* (2013.01)

(58) Field of Classification Search
CPC ..... A61H 3/068; A45B 3/04
See application file for complete search history.

(56) References Cited

U.S. PATENT DOCUMENTS 2,642,519 A * 6/1953 Caustin ..... A45B 3/04 362/577
3,546,467 A * 12/1970 Benham ..... A61H 3/068 250/215
4,099,535 A * 7/1978 Hubachek ..... A45B 3/04 135/66
4,625,742 A * 12/1986 Phillips ..... A45B 3/04 135/66
5,331,990 A * 7/1994 Hall ..... A45B 3/00 135/65
5,588,735 A * 12/1996 Harada ..... A45B 3/00 362/102
5,687,136 A 11/1997 Borenstein
6,774,795 B2 * 8/2004 Eshelman ..... A61H 3/00 340/573.1

(Continued)

OTHER PUBLICATIONS http://www.gizahand.co.uk, "Illuminated Mobility Long Cane," known earliest web published with art on Apr. 2013. Website last accessed on May 18, 2020.

(Continued)

*Primary Examiner* — Noah Chandler Hawk
(74) *Attorney, Agent, or Firm* — Synergy Patent Group

(57) ABSTRACT

A system and apparatus for a mobility cane for the visually impaired to help aid pedestrian identification and provide walking assistance are described. The disclosed embodiments describe, amongst other things, a mobility cane whose shaft length may be illuminated and/or may utilize sensor information to determine illumination patterns. The cane may be a stand-alone device, or may be used in conjunction with a smart mobile device (e.g. smart phone).

19 Claims, 5 Drawing Sheets

(56) References Cited

U.S. PATENT DOCUMENTS

| | | | | |
|---|---|---|---|---|
| 7,267,281 | B2 * | 9/2007 | Hopkins | A61H 3/061 135/911 |
| 8,627,839 | B1 * | 1/2014 | Martinez | A45B 3/00 135/66 |
| 9,970,779 | B2 * | 5/2018 | Kim | G16H 20/40 |
| 2006/0254632 | A1 * | 11/2006 | Willis | A45B 9/00 135/74 |
| 2008/0251110 | A1 * | 10/2008 | Pede | A61H 3/061 135/66 |
| 2014/0299168 | A1 | 10/2014 | Crowhurst | |
| 2016/0300469 | A1 * | 10/2016 | Hood | A45B 3/00 |

OTHER PUBLICATIONS https://www.starwars.com/news/playing-jedi-the-history-of-toy-lightsabers, "Playing Jedi: The History of Toy Lightsabers," known earliest toy was in 1977. Website last accessed on May 18, 2020.
http://www.acb.org/tennessee/white_cane_history.html, "The History of the White Cane," known earliest cane 1921. Website last accessed on May 18, 2020.

* cited by examiner

SYSTEM AND APPARATUS FOR MOBILITY CANE FOR THE VISUALLY IMPAIRED

I. CLAIM TO PRIORITY UNDER 35 U.S.C. § 119

The present application for patent claims the benefit of U.S. Provisional Application No. 62/850,940 filed on May 21, 2019, entitled, "SYSTEM, METHOD AND APPARATUS FOR PROVIDING VISUALLY IMPAIRED PEDESTRIAN IDENTIFICATION AND WALKING ASSISTANCE," owned by the applicant hereof, and expressly incorporated herein by reference in its entirety.

BACKGROUND

Field

The disclosed embodiments relate to a system and apparatus for mobility cane/s for the visually impaired to help aid pedestrian identification and provide walking assistance.

Every year, thousands of visually impaired pedestrians are at risk of bodily harm due to the fact that others may have difficulty identifying or seeing them as visually impaired pedestrians, thus, less likely to use caution around them. Walking canes for assisting visually impaired pedestrians are known (e.g. white cane). Walking canes for assisting visually impaired pedestrians that utilized some form of lighting are also known. However, current canes that utilize lights may not give enough notice to the public to help them identity a visually impaired pedestrian or be responsive to the environment they are in. This may be true especially in some environments like daytime or busy street intersections. Some solutions proposed comprise utilizing red markings as a universal indicator of visually impaired pedestrians. Previous solutions that utilize lighting do so efficiently and fail to provide a comprehensive solution for aiding identification of visually impaired pedestrians to the rest of the public. Moreover, prior solutions may not actively adapt to the visually impaired person's environment or be customizable to their unique needs. Therefore, there is a need in the art for a system and apparatus for mobility cane/s for the visually impaired to help aid pedestrian identification and provide walking assistance.

SUMMARY

A system and apparatus for mobility cane/s for the visually impaired are described. In an embodiment, a mobility cane is described comprising: a handle housing a circuit module, a sensor module, and a power source, the circuit module configured to receive sensor information from the sensor module; a shaft body removeably secured to the handle, the shaft body capable of housing at least one light source, the circuit module configured to illuminate the at least one light source with a lighting pattern based upon the received sensor information; and a base tip module comprising a removably secured base tip, at least one reflective surface, the base tip module being removeably secured to the shaft body.

In another embodiment, a mobility cane is described comprising: a handle configured to house a flashlight; a shaft body removeably secured to the handle, the shaft body capable of housing a light pipe, the flashlight configured to illuminate the light pipe; and a base tip module comprising a removably secured base tip, the base tip module being removeably secured to the shaft body.

BRIEF DESCRIPTION OF THE DRAWINGS

The following embodiments may be better understood by referring to the following figures. The figures are presented for illustration purposes only, and may not be drawn to scale or show every feature, orientation, or detail of the embodiments. They are simplified to help one of skill in the art understand the embodiments readily, and should not be considered limiting.

DETAILED DESCRIPTION

Each of the additional features and teachings disclosed below can be utilized separately or in conjunction with other features and teachings to provide a system and apparatus for mobility cane/s for the visually impaired to help aid pedestrian identification and provide walking assistance, broadly referred to herein as "mobility cane," "cane" or "See Me Cane." Representative examples of the following embodiments will now be described in further detail with reference to the attached drawings. This detailed description is merely intended to teach a person of skill in the art details for practicing the preferred aspects of the teachings and is not intended to limit the scope of the embodiments.

The disclosed embodiments describe a mobility cane having illumination functionality that facilities advanced identification, automation of some features, customization, and walking assistance for visually impaired pedestrians by emanating light throughout the entirety of the cane. For example, in some embodiments, the mobility cane, may cause light to propagate and reflect throughout entirety of the cane body. The light propagated may utilize different lighting patterns. The user of the cane may customize their settings aiding them in specific walking environments and providing them more technical/tactile feedbacks. The cane may provide increased awareness and safety for visually impaired pedestrians by identifying and providing illumination that identifies as visually impaired to others. However, in a manner that facilitates increased accuracy, customization, automation, and efficiency compared to previous walking assistance solutions. In addition, the cane may provide the user of the cane with valuable tactile feedback not typically associated with mobility canes.

Figure 1:
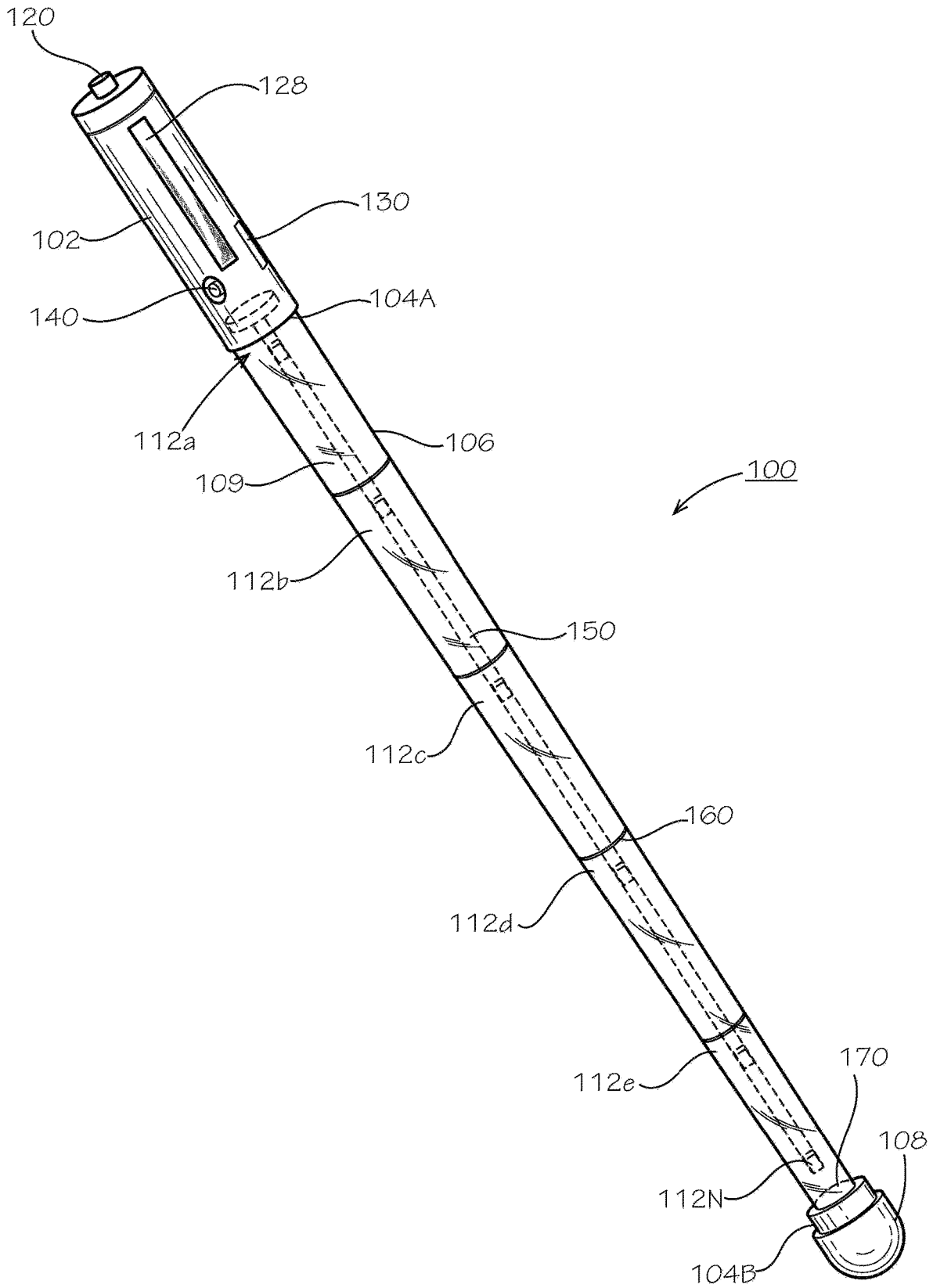
FIG. 1. illustrates a general overview of a mobility cane in an embodiment.

FIG. 1 illustrates a general overview of a See Me Cane 100 in an embodiment. The mobility cane 100 may comprise a handle 102, coupling (e.g. connectors, connection modules) on the ends of the cane 104A and 104B, shaft body 106, and base tip 108. Cane 100 may also comprise a grip 128 coupled to the handle 102, a speaker outlet (speaker port) 140, an on/off switch or button 120, a reflector 170, and a USB or connection port 130.

Handle 102 may comprise a variety of shapes and sizes. Handle 102 may be fashioned with a spherical-shaped (e.g.

ball) handle or other comfortable shape. In an embodiment, handle 102 may comprise a straight shaped handle, a T shape handle, L shape handle, and the like. In some embodiments, handle 102 may be constructed from a material that increases user friendliness and comfort. For example, handle 102 may comprise a golf-club style handle and may comprise materials such as: rubber, plastic, metal, foam, cork, wood, fiberglass, graphite, or any other material suitable for providing increased user grip, style, and comfort. Handle 102 may comprise grip 128. Grip 128 may encompass a portion of handle 102 exterior or a portion of the handle exterior. Grip 128 may comprise ergonomic functionality and features. For example, grip 128 may be contoured to be form fitting of a user's hands and fingers. Grip 128 may be constructed of neoprene, latex, gel-based coating, memory foam, rubber, plastic, foam, leather, metal, cork, fiberglass, graphite, or any other material suitable for providing increased user grip and comfort. In some embodiments, discussed in further detail below, handle 102 may have a USB/communication/charging port 130 to charge a battery (or battery equivalent) and allow for wired communication. In an embodiment, the handle may house electronic circuitry: circuit board/s, components, connectors, GPS receivers, accelerometer/gyroscope, piezo sensors, LEDs, speakers, vibrators, memory, processors, power sources, motion sensors, and the like. Handle 102 may be removably connected on a first end of shaft body 106 via coupler 104A. Handle 102 may be removeably secured to the end of the shaft body 106 or permanently attached to the shaft body 106. In an embodiment, handle 102 may be connected to the proximal end (relative to the user holding the See Me Cane) of shaft 106, via coupling 104A. Coupling 104A or 104B may be a threaded connection assembly, a friction coupled assembly, or equivalent removeably secure connection. The threading may be male or female with corresponding threaded connectors or caps. In an embodiment, coupling 104A may facilitate coupling of handle 102 to shaft body 106 utilizing fasteners and screws, clamps, clips, switches, screws, and latches. In some embodiments, handle 102 may be designed to be removably connected to coupling 104A. Handle 102 may be removably attached to coupling 104 in order to provide access to a battery casing and handle interior of handle 102. As used herein, the statement that two or more parts or components are "coupled" shall mean that the parts are joined or operate together either directly or indirectly (i.e., through one or more intermediate parts or components, so long as a link occurs).

In an embodiment, shaft body 106 may be constructed utilizing one or more of: polymers composites that have glass fibers, carbon fiber, plastic, glass, plexiglass, wood, light weight metals, and/or other materials suitable for supporting the structural requirements to support the weight of a user needing walking assistance. Constructing a shaft from polymer composites with glass may allow for a light weight cane shaft with enough strength. In an embodiment, shaft body 106 may be translucent, opaque, transparent, partially translucent, patterned, textured, with punctures (holes) or any combinations thereof. Shaft body 106 may emit light from the inside to the outside in order to illuminate the whole of shaft body 106. For example, shaft body 106 may be constructed from a light weight metal with punctures to allow light to emanate from inside of it outwardly. The shaft body 106 may be textured with raised plastic lines or grooves on the outside of the shaft body such that the light emanating from within is highlighted by the textured plastic. In an embodiment, shaft body 106 may house an inner light tube or pipe (hollow or solid) 150. The inner light tube (e.g. pipe) may be constructed with materials that allows light to travel down inside the light tube (e.g. bouncing off the inside tube walls). A reflector 170 at the end of the pipe (e.g. tube) may bounce the light back up the pipe. In an embodiment, the tube may allow 80%-95% of light reflecting (traveling) up and down the tube. Light tube 150 may help amplify the light and illuminate the entire shaft. Shaft 106 may be a solid rigid shaft, a segmented shaft that can collapse, a telescoping collapsible shaft, etc. FIG. 1 for conciseness illustrates a solid shaft as well as an optional embodiment of a segmented collapsible shaft with segment joints 160 for a collapsible shaft embodiment (See FIGS. 3A & 3B). In an embodiment, the collapsible shaft assembly may be held together utilizing one or more of a string, a langured, a cable, a wire, a cord, an elastic thread, rope, elastic wiring, and/or cord or any combinations thereof (e.g., wire 109). In an embodiment, the shaft segments may be configured to help hold the extended (non-collapsed mode) segments in place. For example, they may have raised ring rims that fit into corresponding ringed slots, thus, mating to each other, but able to be separated easily in order to collapse.

In an embodiment, mobility cane 100 may comprise elastic wire 109 and light modules (or light sources) 112*a-n*. Elastic wire (or wire) 109 may run along from a first end of shaft body 106 to a second end of shaft body 106. In an embodiment, the elastic wire may run between the coupling 104A area to the cane tip 108 area (or coupling 104B). In an embodiment, elastic wiring 109 may be coiled, stretched, bound, looped, or fold inside shaft body 106 and fastened onto couplers 104A and/or 104B. In some embodiments, light modules 112 in conjunction with elastic wiring 109 may together comprise a wired light strip or elastic wiring light bulb assembly. In an embodiment, the light sources may be coupled to the elastic wire. Wire 109 itself may be a single cohesive light strip. In some embodiments light module/s 112 and wiring 109 may comprise an elastic wiring light assembly including but not limited to: light strip, LED stripe or strip, LEDs, light bulbs, light tape, light string, wire light script, elastic wiring light bulbs, and the like. In some embodiments, the cane 100 may comprise a shaft body 106 having a wire light assembly 309 configured to allow the collapsibility of a segmented shaft (FIG. 3A) or the telescoping flexibility of the shaft (FIG. 3B).

In an embodiment, light module/s (or source/s) 112 may comprise one or more conventional light bulbs, organic light emitting diode (OLED), quantum-dot light emitting diode (QLED), carbon-dot light emitting diode (CLED), and the like. In an embodiment, each section of a collapsible shaft 360*a-n* may comprise a dedicated light module 112. Light module/s 112 may comprise one or more light bulbs, for example halogen bulbs, fluorescent bulbs, LEDs and the like. However, in some embodiments only subsections at a first end and/or at the second end of shaft body 106 may comprise a light source. In other words, there may be one light source or two instead of a plurality. In an embodiment, shaft body 106 may comprise only one light module in the entirety of shaft body 106, for example at a first end or at a second end of shaft body 106. In these single/fewer light embodiments, reflector/s may be used to propagate the light throughout the entirety of the shaft body 106. The shaft body 106 may comprise various shapes. For example, the shaft body perimeter may comprise a square, cylindrical, rectangular, pentagon, hexagon, and/or octagon shape, or any combinations thereof.

Base tip 108 in an embodiment, may be a base tip module compromising a shaft body end cap that may help prevent a reflector from falling out of the shaft or may house a reflector, and provide a means to connect replaceable or interchangeable tips. Base tip 108 may comprise various sizes and shapes of tips for tactile feedback. Each particular type of tip may have various functionality and advantages to the user. This provides the user with the ability to interchange base tips 108 that may fit a user's changing needs. In an embodiment, a tapping tip or a sweeping tip may be used. Tapping tips may be tips that help the user tap the ground and receive tactile feedback that provides information about the condition of the ground. Tapping tips may comprise shapes that are round, cylinder, pointed or disked. Sweeping tips may be tips that comprise a bearing inside the tip, which allows the user to have continuous contact of with the ground at all times. Sweeping tips shapes may be round, wheel, cylinder, and/or curved. Other shapes and sizes for tips may be utilized without diverting from the scope and spirit of the exemplary limitations described above and have been fully contemplated herein. Tip 108 may also comprise typical ball shaped tips, as is known in the art. In an embodiment, base tip 108 may comprise one or more of: a reflector, a light bulb, or other means of light product in the inside of the tip (e.g. solid-state lighting devices). Tip (or base tip) 108 may comprise a connection means for the wire 109 to connect to the tip: e.g. a hook, slide, clamp, or any appropriate device configured to physically connect the wiring (e.g. elastic wiring 109) to the tip 108.

Cane 100 may comprise a single reflector 170 at a first end of shaft body or at an opposite end. However, in some embodiments, a plurality of reflective surfaces may be present throughout shaft body 106. In some embodiments, reflective surfaces comprise mirrors and/or lenses, reflective material strips, or light tubes, configured to amplify and direct light beam/s in a manner that scatters a light beam as to provide maximum luminance for the cane. In some embodiments, shaft body 106 may comprise metals particles (not shown), which may increase the intensity of light propagating through shaft body 106. For example, shaft body 106 may comprise aluminum particles embedded in translucent plastics, which assist to reflect light.

Figure 2:
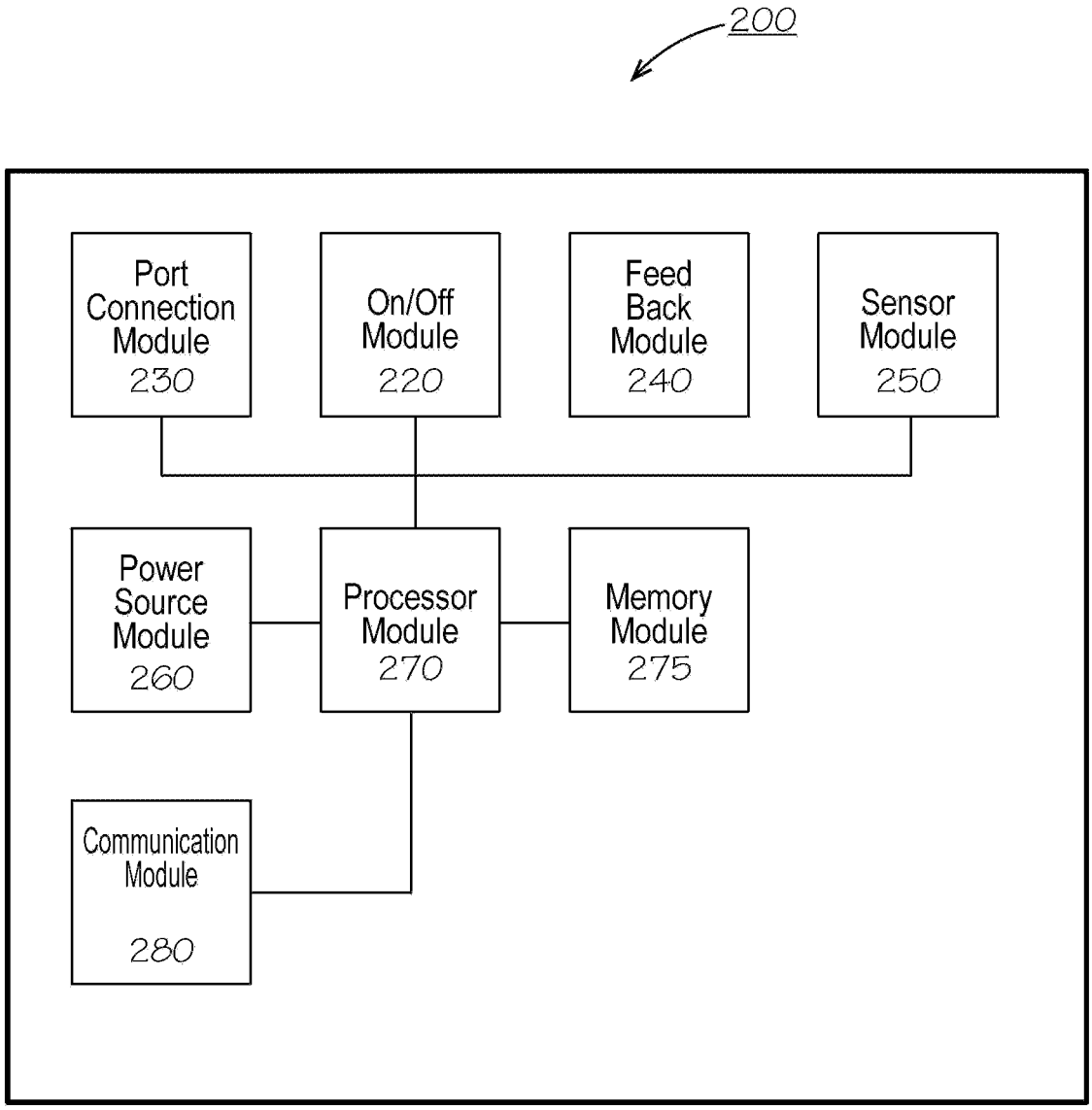
FIG. 2. illustrates a block diagram of cane circuitry in an embodiment.

FIG. 2 illustrates a block diagram 200 of cane circuitry in an embodiment. Cane circuitry module 200 may comprise a circuit board and corresponding connectors and components. Cane circuitry 200 may comprise a port/connection module 230, on/off module 220, a feedback module 240, a sensor module 250, a power source module 260, a processor module 270, a memory module 275, and a communications module 280. In an embodiment, the cane handle portion 102 may house circuitry inside the handle. Handle 102 may have an internal chamber capable of receiving/housing a flashlight, and/or capable of receiving/housing cane circuitry 200. In an embodiment, handle 102 may comprise access holes or ports. For example, handle 102 may provide an access port for plugging in a USB cable which in turn connects to a connector mounted on or wired into and part of the port/connection module 230 of cane circuitry 200. Cane circuitry 200 module's may be in the various cane embodiments disclosed 100, 300A, 300B, and 500.

In an embodiment, power source module 260 may comprise at least one battery or equivalent energy storage (e.g. a capacitor bank). The battery housing may be a separate compartment off board from the circuit board or it may be a receptable on the circuit board depending on the type and size of the battery used. In an embodiment, the battery is a rechargeable battery. In an embodiment, one or more batteries or storage may be present. For example, there may be a small coin sized battery on the circuit board and a battery inside a flashlight 530. The power module 260 may provide power to all of the cane circuitry 200.

Figure 5:
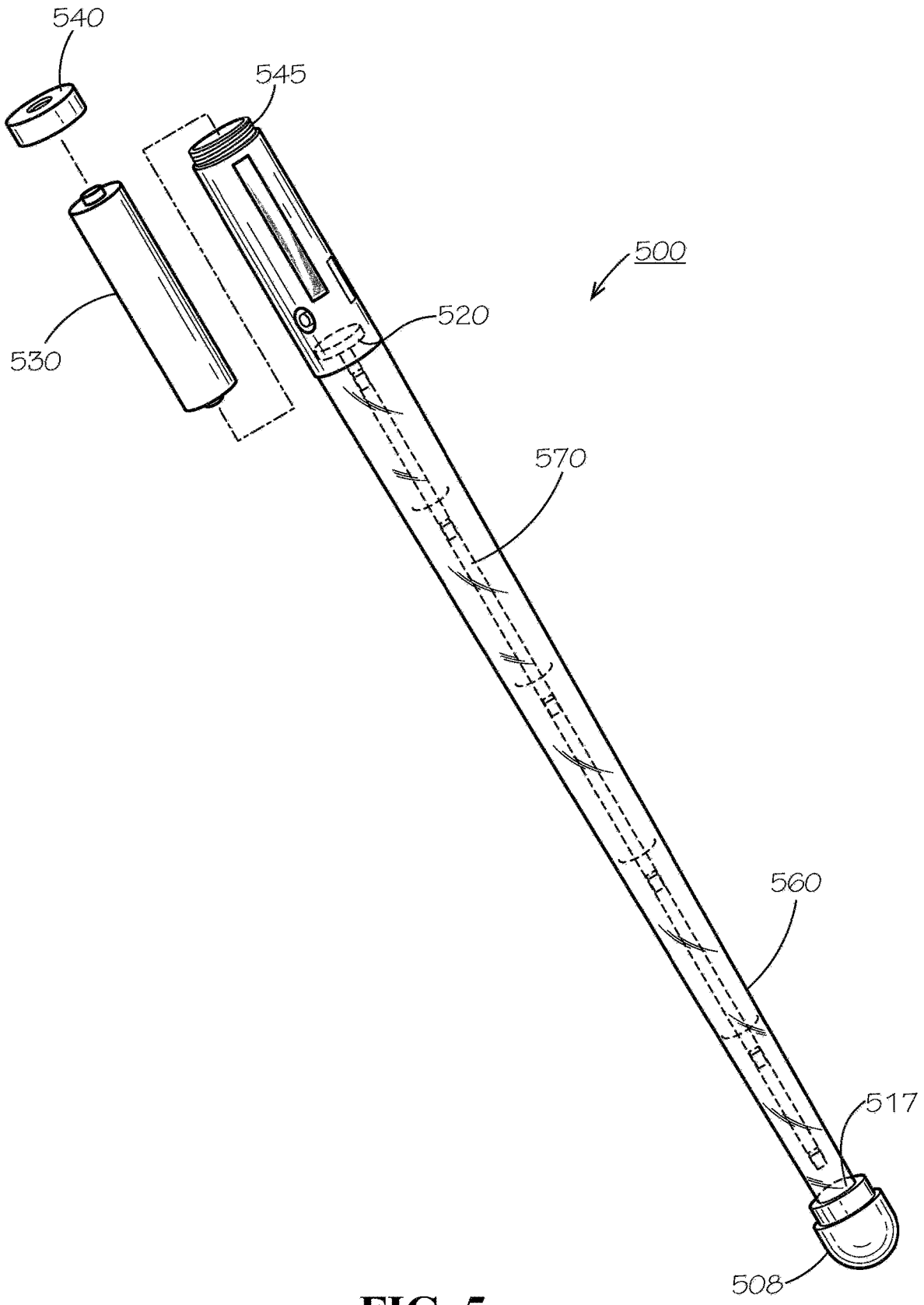
FIG. 5. illustrates a mobility cane in an embodiment.

In an embodiment, on/off switch 120 (power switch) may be electrically or mechanically coupled and/or part of on/off module 220. In an embodiment, on/off switch 120 is part of a flashlight (FIG. 5). In an embodiment, on/off switch may be a push button. In an embodiment, sensor module 250 may detect a user's hand on the handle and automatically turn cane circuitry on/off and/or activate the lighting pattern. In an embodiment, a safety mechanism may be in place to detect if the cane's light is actually on or off. For example, a specifically placed light detector may be placed such that it reads the cane's light source/s primarily and can effectively ignore the ambient light outside of the cane. In an embodiment, sensor module 250 may comprise a photodiode (or light detecting device/sensor) inside the cane's shaft close to light source/s 112 & 530. In an embodiment, processor module 270 may determine if the light source is on or off based on the photodiode's electrical feedback. In some embodiments, processor module 270 may comprise an integrated controller such as a universal serial bus (USB) or serial ATA (SATA) controller. In some embodiments, processor module 270 may be implemented as a system-on-a-chip SOC or other chipset (e.g., field programmable gate arrays (FPGA) and the like). In some embodiments, processor module 270 may comprise a plurality of solid-state storage devices coupled to, and/or comprised in, processor module 270.

In some embodiments, processor module 270 may comprise one or more hardware processors in conjunction with memory module 275 comprising one or more memory devices having computer readable instructions stored thereon (i.e., software code). In some embodiments, processor(s) of processor module 270 may be in communication with a memory and configured to execute software code in order to implement the exemplary embodiments described herein. Software code may comprise non-transitory computer readable instructions that when executed by processor implement one or more embodiments described herein. In some embodiments, processor module 270 may comprise one or more field programmable gate arrays (FPGA) and or other processing circuitry.

Memory module 275 may comprise any electronic storage media suitable that electronically stores information. The electronic storage media of memory module 275 may comprise one or both of system storage that is provided integrally (i.e., substantially non-removable) with processor module 270 and/or removable storage that is removably connectable to processor module 270 via, for example, port connection module 230 (e.g., a USB port, memory card port, a firewire port, etc.) or a drive (e.g., a disk drive, etc.). Memory module 275 may utilize one or more virtual storage resources (e.g., cloud storage, a virtual private network, cell phone storage, and/or other virtual storage resources). Memory module 275 may comprise solid-state storage devices for example flash integrated circuits, Chalcogenide RAM (C-RAM), phase change memory, programmable metallization cell RAM, resistance RAM, and NAND/NOR memory, ferroelectric memory, and/or other discrete non-volatile memory chips. Memory module 275 may store software algorithms, information determined by processor (s) of processor module 270, information received from sensor module 250, and/or other information that enables mobility cane to perform the exemplary embodiments described herein.

Processor module 270 may comprise one or more of: a digital processor, an analog processor, a digital circuit designed to process information, an analog circuit designed to process information, a state machine, and/or other mechanisms for electronically processing information. In an embodiment, processor module 270 may comprise a plurality of processing units. These processing units may be physically located within the same device, or processor module 270 may represent processing functionality of a plurality of devices operating in coordination. In some embodiments, processor module 270 may receive data input from the sensor module 250 or sensor or data information from a smart mobile device (e.g. cell phone, tablet) not shown.

In an embodiment, communication module 280 may wirelessly communicate, and/or have a wired transceiver (communicate via wire). In an embodiment, communication module 280 may include a Bluetooth® capable transceiver, a WiFi capable transceiver, or any wireless capable transceiver as is well known in the art. Communication module 280 may comprise circuitry, RF antennas, modems, mixers, amplifiers, filters, radios, encoders, decoders, coders, modulators, convertors, demodulators, baseband processors, USB drivers, connectors, or any components or circuitry required for wireless or wired communication as is well understood in the art. The information may be raw data or processed data. In an embodiment, the information sent or received may be encrypted. The communication module 280 may send and receive information to and from a smart phone application (not shown).

In an embodiment, mobility cane 100 may comprise a feedback module 240. Feedback module 240 may have one or more of a vibration motor, speaker, small brail read out strip, or an audio jack that a headset may be plugged into. In an embodiment, feedback devices on a smart phone in communication via communication module 280 with the cane may be used. For example, when the cane is turned on, the cane's speaker or a smart phone's speaker may let the user know with words, sounds, beeps etc. that the cane is on. The vibrator may be used for specific user feedback. For example, when the cane is powered on, a pattern of vibration may be provided. In an embodiment, a sequence of vibrations may be given, for example, one to four pulses that increase in intensity each pulse. In an embodiment, the user may receive feedback about location. For example, via some sensors on the cane's circuitry or via a mobile device, the processor module or phone app may determine that a user is at a certain street intersection and inform the user via speech commands. Any combinations of user feedback are contemplated and considered within the scope of the disclosure.

Sensor module 250 may comprise photodiode, location sensors, GPS receivers, accelerometers, gyroscopes, proximity sensors, capacitance sensors, ambient light sensor, temperature sensor, humidity sensor, heartbeat detection sensor, motion sensor and so forth. In an embodiment, See Me Cane 100 may utilize location data, time information, and/or other sensed environmental data, in order to adjust a luminance level, color, patterns, etc. of the cane's illumination settings. In an embodiment, sensor module 250 may comprise near field communication (NFC) such as radio frequency identification (RFID) and/or Active RFID, which can determine whether the user is in an indoor or outdoor environment. Based on a determination of indoor or outdoor usage provided by RFID chips, mobility cane 100 may adjust a luminance setting. For example, when sensors provide an indication that an active RFID sensor is present, information received by sensor module 250 from a detected active RFID chip may provide information corresponding to the location and environmental conditions of the RFID chip based on RFID protocol. In an embodiment, sensor module may receive sensor information from a smart mobile device. For example, a smart phone may know if it's indoors or outdoors and communicate that information to mobility cane 100.

In an embodiment, processor module 270 may adjust the light/s 112 in colors, patterns, intensity, or any combination thereof. For example, processor may detect via sensor information 250 that cane 100 is being used at night in a busy part of town or intersection. The processor module may change the light from a single on state to a pulsating or flashing light. For example, lights 112*a-n* may be lit up in a sequence (timing pattern), or flashing. The lights may change colors etc. Any possible configurations of light patterns are contemplated herein. In some embodiments, processor module 270 may utilize a vibration motor or speaker from the feedback module 240 to notify a user of changes in location or user environment as well as change a lighting pattern. For example, a user may use a different light setting in a grocery store v. outside in daylight and may be informed via feedback module 240 of the change in environment. In an embodiment, See Me Cane 100 may flash red and white as a specific alert. In an embodiment, the tactile feedback or light patterns etc. a user may wish to have may be customizable or factory set. For example, a user app may communicate with system 100 to configure user settings. The user app may be implemented on a smart phone, computer, laptop, or any suitable device as in well known in the art. The user app may communicate wired or wirelessly with a communication module 280.

In some embodiments, cane 100 may communicate and function with an accompanying app (application) based on a user's smart phone or personal computing device (not shown). The app may allow the user to personalize (or customize) mobility cane settings. The app may be in communication with circuitry 200 on the cane. The cane may offload some user feedback or processing to the app. Cane 100 may use the phone's speaker for alerts. By utilizing a GPS sensor, either on the cane or on the smart device, the system may gauge and track ambient light based on GPS and other sensor settings to help determine: ambient light, time of day, indoors v. outdoors, location, and other environmental indicators that may be used to implement specific illumination settings. For example, during a sunny summer day outside there may be higher levels of ambient light in the environment, the app or cane may determine to set the illumination settings to high brightness/visibility etc., because it may be more difficult to see the cane's illumination in a bright environment. Also, if the app or cane determines that it may be night time, the cane's illumination settings may be lowered or changed in patterns etc. to avoid causing light distraction to others, but bright enough to clearly indicate that a visually impaired pedestrian is nearby. The mobility cane 100 may determine based on location sensors and information that the user is in another country and use those country alerts (lighting patterns) while the user is in another country. In an embodiment, the See Me Cane 100 comprising cane circuitry 200 may receive input data signals from one or more environmental sensors such as an ambient light sensor. An ambient light sensor may sense a change in the level of ambient light in the environment, for example during sunset. Upon determining that a level of ambient light in the environment has reached below a threshold level of ambient light, processor module 270 may be configured to control a luminance level or light intensity corresponding light pattern response.

Figure 3A:
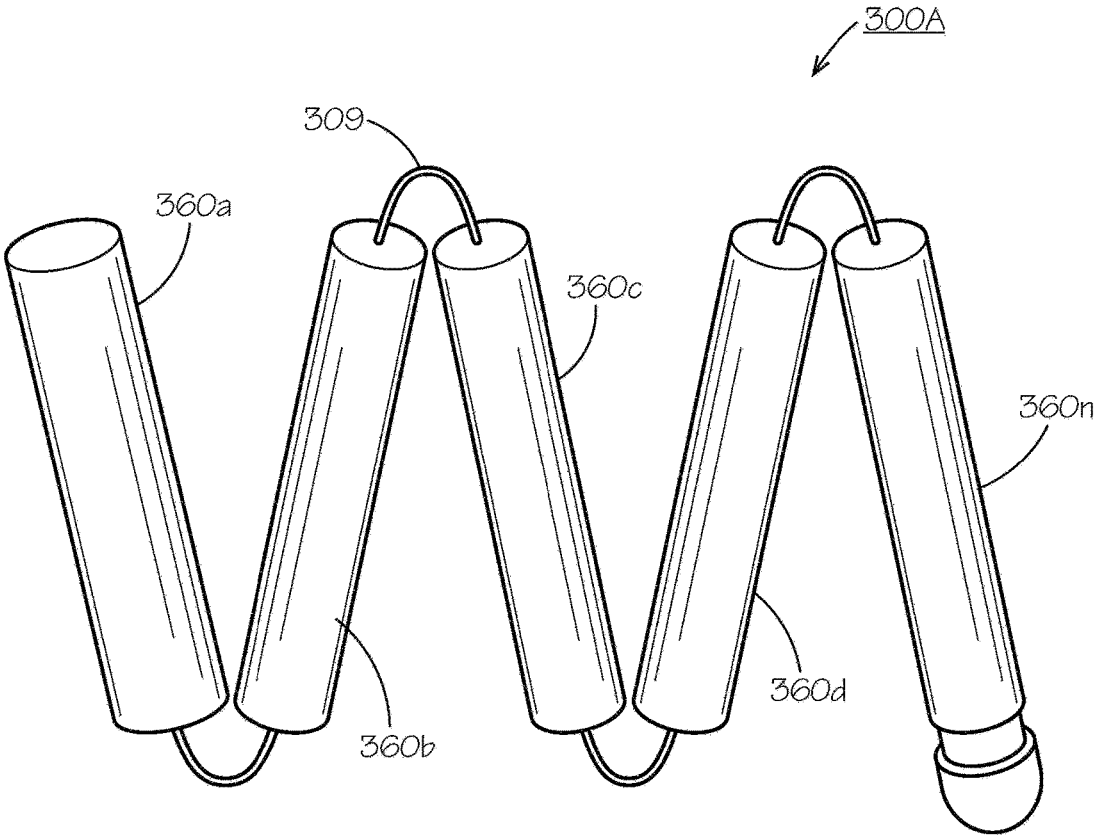
FIG. 3A. illustrates a collapsed view of a mobility cane in an embodiment.
Figure 3B:
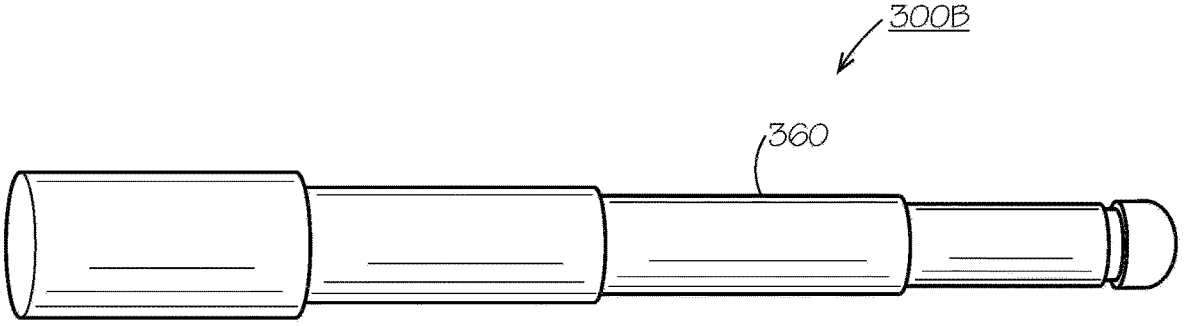
FIG. 3B. illustrates a telescoped view of a mobility cane in an embodiment.

FIG. 3A illustrates a collapsed view 300A of a mobility cane in an embodiment. In an embodiment, the cane's shaft 106 or 560 may be configured to be collapsible. In this configuration, shaft segments 360*b-n* may house an elastic wire 309 & 109 (or partial elastic sections of wire). The handle 102 is shown here as a "segment" 360*a*. The light source/s 112 may be in the segments or at the ends of the shaft as described above.

FIG. 3B illustrates a telescoped view 300B of a mobility cane in an embodiment. In an embodiment, the cane's shaft 106 or 560 may be configured to be collapsible in a telescoped manner. In an embodiment, telescoping shaft 360 may house an elastic wire 109 (or partial elastic sections of wire), or not.

Figure 4:
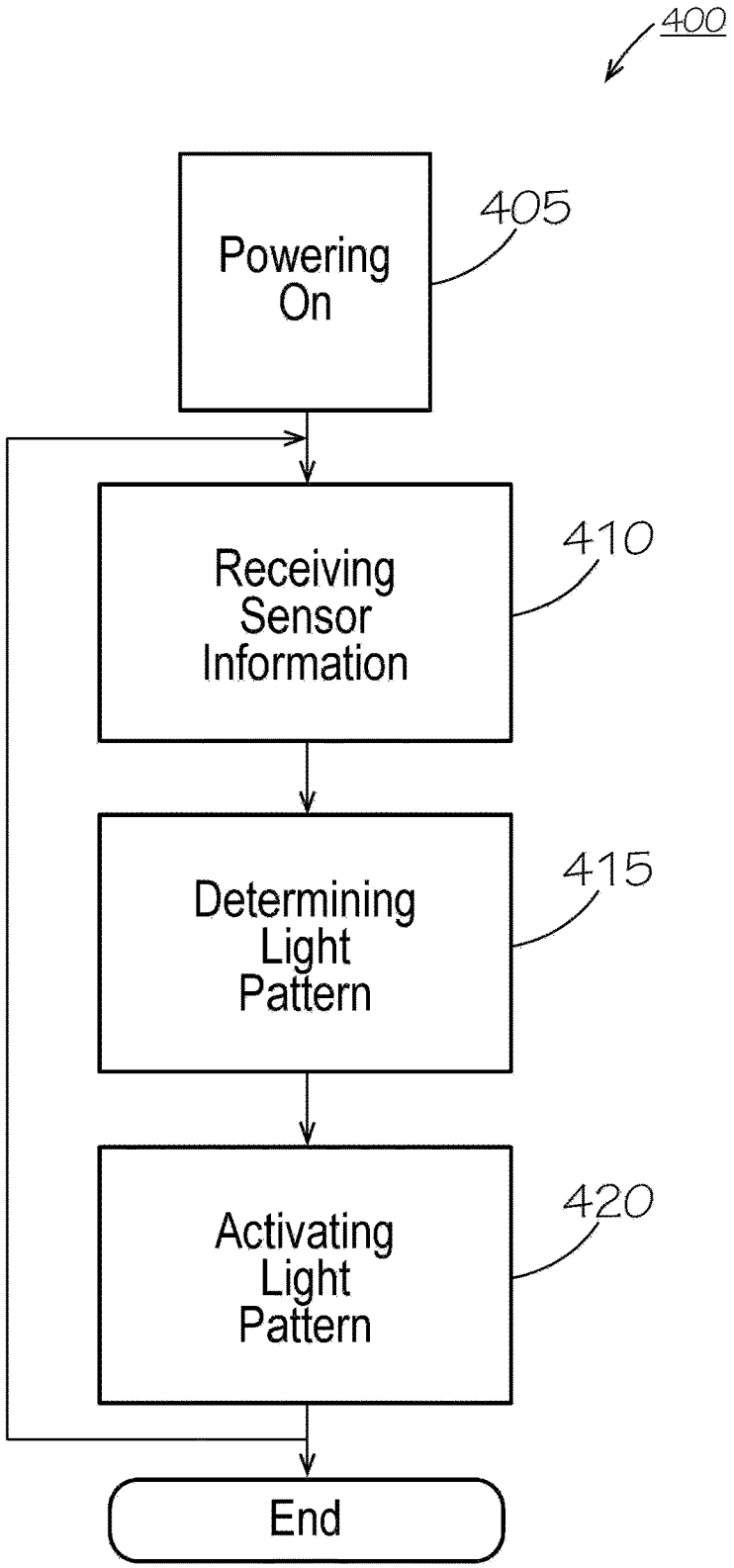
FIG. 4. illustrates a method for using a mobility cane in an embodiment.

FIG. 4 illustrates a method 400 for using a mobility cane in an embodiment. At step 405, powering on the cane. The powering on may be done via any of the previously discussed embodiments. At step 410, receiving sensor information. The sensor information may be on-board the cane or off-board on a smart device as discussed in the previous embodiments. At step 415, degerming a light pattern. The cane via the circuitry in conjunction with or without a smart device may determine a light pattern as discussed in the previous embodiments. For example, based on user customized settings. Finally, at step 420, activating a light pattern. The cane in conjunction with or without a smart device may activate (illuminate) the light pattern as discussed in the previous embodiments. The process may repeat at 410 or end.

FIG. 5 illustrates a mobility cane 500 in an embodiment. In an embodiment, flashlight 530 (either off-the-shelf or specially designed for) may be inserted into the cane's handle 102. The flashlight may comprise an off/on button and light source as is well known in the art. A handle cap 540 may be removed to allow the flashlight 530 into the handle's hollowed out area. Cap 540 may have a hole or cutout on the cap's top surface to allow the flashlight's existing on/off button to be exposed to the user. Cap 540 may be threaded female or male and connect to a corresponding thread 545 on the handle. A mechanical stop 520 may be housed in the cane's shaft that prevents the flashlight from falling down the shaft, but allows for the flashlight's light source to propagate down the cane's shaft. In an embodiment, mechanical stop 520 may comprise a passive or active light amplifier or light coupling device. A light pipe or reflective strip 570 as discussed may be housed inside the cane shaft (e.g. body) 560. The cane's base tip 508 as discussed in previous embodiments may house a reflector/s 517 and be configured to allow replacement tips.

In other embodiments, the processing modules may be implemented using a shared processing device, individual processing devices, or a plurality of processing devices. Such a processing device may be a microprocessor, microcontroller, digital signal processor, microcomputer, central processing unit, field programmable gate array, programmable logic device, state machine, logic circuitry, analog circuitry, digital circuitry, and/or any device that manipulates signals (analog and/or digital) based on operational instructions.

The described embodiments or any part(s) or function(s) thereof, may be implemented using hardware, software, or a combination thereof, and may be implemented in one or more computer systems or other processing systems. A computer system for performing the operations of the described embodiments and capable of carrying out the functionality described herein can comprise one or more processors connected to a communications infrastructure (e.g., a communications bus, a cross-over bar, or a network). Various software embodiments are described in terms of such an exemplary computer system. After reading this description, it will become apparent to a person skilled in the relevant art(s) how to implement the embodiments using other computer systems and/or architectures.

The foregoing description of the preferred embodiments has been presented for purposes of illustration and description. It is not intended to be exhaustive or to limit the embodiments to the precise form or to exemplary embodiments disclosed. Obviously, many modifications and variations will be apparent to practitioners skilled in this art. Similarly, any process steps described might be interchangeable with other steps in order to achieve the same result. The embodiments were chosen and described in order to best explain the principles of the embodiments and its best mode practical application, thereby to enable others skilled in the art to understand the various embodiments and with various modifications as are suited to the particular use or implementation contemplated. It is intended that the scope of the embodiments be defined by the claims appended hereto and their equivalents. Reference to an element in the singular is not intended to mean "one and only one" unless explicitly so stated, but rather means "one or more." Moreover, no element, component, nor method step in the described disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . ."

In addition, the conjunction "and" when used in the claims is meant to be interpreted as follows: "X, Y and Z" means it can be either X, Y or Z individually, or it can be both X and Y together, both X and Z together, both Y and Z together, or all of X, Y, and Z together.

It should be understood that the figures illustrated in the attachments, which highlight the functionality and advantages of the described embodiments, are presented for example purposes only. The architecture of the described embodiments are sufficiently flexible and configurable, such that it may be utilized (and navigated) in ways other than that shown in the accompanying figures.

Furthermore, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is not intended to be limiting as to the scope of the described embodiments in any way. It is also to be understood that the steps and processes recited in the claims need not be performed in the order presented.

Also, it is noted that the embodiments may be described as a process that is depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a function, a procedure, a subroutine, a subprogram, etc. When a process corresponds to a function, its termination corresponds to a return of the function to the calling function or the main function. A process or method may be implemented with a processor, or similar device, or any combination of hardware and software.

Moreover, a storage medium may represent one or more devices for storing data, including read-only memory (ROM), random access memory (RAM), magnetic disk storage mediums, optical storage mediums, flash memory devices and/or other machine-readable mediums, processor-readable mediums, and/or computer-readable mediums for storing information. The terms "machine-readable medium", "computer-readable medium", and/or "processor-readable medium" may comprise, but are not limited to non-transitory mediums such as portable or fixed storage devices, optical storage devices, and various other mediums capable of storing, containing or carrying instruction(s) and/or data. Thus, the various methods described herein may be fully or partially implemented by instructions and/or data that may be stored in a "machine-readable medium", "computer-readable medium", and/or "processor-readable medium" and executed by one or more processors, machines and/or devices. Moreover, a microprocessor, or similar device may have internal or external memory associated with it.

The various features of the embodiments described herein can be implemented in different systems without departing from the embodiments. It should be noted that the foregoing embodiments are merely examples and are not to be construed as limiting the embodiments. The description of the embodiments is intended to be illustrative, and not to limit the scope of the claims. As such, the described teachings can be readily applied to other types of apparatuses and many alternatives, modifications, and variations will be apparent to those skilled in the art.

What is claimed is:

1. A mobility cane for the visually impaired, comprising:

a handle housing a circuit module, a sensor module, and a power source, the circuit module configured to receive sensor information from the sensor module, wherein the sensor module comprises a light detector configured to detect light from the at least one light source while ignoring ambient light;

a shaft body removeably secured to the handle, the shaft body capable of housing at least one light source, the circuit module configured to direct the at least one light source to illuminate the shaft body with a lighting pattern based upon the received sensor information; and a base tip module comprising a removably secured base tip, at least one reflective surface, the base tip module being removeably secured to the shaft body.

2. The mobility cane of claim 1, wherein the sensor module comprises an ambient light detector.

3. The mobility cane of claim 1, wherein the sensor module comprises at least one of a photodiode, location sensor, GPS receiver, accelerometer, gyroscope, proximity sensor, capacitance sensor, ambient light sensor, temperature sensor, humidity sensor, heartbeat detection sensor, and motion sensor.

4. The mobility cane of claim 1, wherein the at least one light source comprises a light bulb, an organic light emitting diode (OLED), a quantum-dot light emitting diode (QLED), a carbon-dot light emitting diode (CLED), an LED or any combinations thereof.

5. The mobility cane of claim 1, further comprising:

an elastic wire.

6. The mobility cane of claim 1, wherein the at least one light source, further comprises:

a light strip, LED stripe or strip, LEDs, light tape, light string, wire light script, and elastic wiring light strip.

7. The mobility cane of claim 1, further comprising:

the shaft body houses a reflecting strip.

8. The mobility cane of claim 7, wherein the reflecting strip comprises a light tube.

9. The mobility cane of claim 1, wherein the shaft body comprises polymer composites that have glass fibers.

10. The mobility cane of claim 1, wherein the shaft body is translucent, opaque, transparent, partially translucent, patterned, textured, punctured, or any combinations thereof.

11. The mobility cane of claim 1, wherein the shaft body is configured to telescope or be collapsible.

12. The mobility cane of claim 1, wherein the lighting pattern is customizable for individual users and for specific user environments.

13. The mobility cane of claim 1, wherein the shaft body has a perimeter shape of a square, cylindrical, rectangular, pentagon, hexagon, octagon shape, or any combinations thereof.

14. The mobility cane of claim 1, wherein the base tip is configured to allow replacement tips.

15. The mobility cane of claim 1, wherein the handle further comprises at least one of a grip, an on/off switch, a connection port, a vibration motor, and a speaker.

16. The mobility cane of claim 1, wherein the base tip comprises a tapping tip or a sweeping tip.

17. The mobility cane of claim 1, wherein the power source comprises a rechargeable battery.

18. The mobility cane of claim 1, wherein lighting pattern comprises a red and white colored alert.

19. The mobility cane of claim 1, wherein the lighting pattern comprises a higher visibility pattern for bright ambient environments and a lower visibility pattern for dim ambient environments.

* * * * *